US008134511B2

(12) United States Patent
Koh et al.

(10) Patent No.: US 8,134,511 B2
(45) Date of Patent: Mar. 13, 2012

(54) LOW PROFILE QUASI-OPTIC PHASED ARRAY ANTENNA

(75) Inventors: Christopher Tze-Chao Koh, South Deerfield, MA (US); Thomas Robert Newman, Williamsburg, MA (US); Kent Arthur Whitney, Sunderland, MA (US)

(73) Assignee: Millitech Inc., Northampton, MA (US)

( * ) Notice: Subject to any disclaimer, the term of this patent is extended or adjusted under 35 U.S.C. 154(b) by 763 days.

(21) Appl. No.: 12/149,273

(22) Filed: Apr. 29, 2008

(65) Prior Publication Data

US 2008/0278394 A1 Nov. 13, 2008

Related U.S. Application Data

(60) Provisional application No. 60/924,098, filed on Apr. 30, 2007.

(51) Int. Cl.
*H01Q 19/06* (2006.01)
*H01Q 19/10* (2006.01)

(52) U.S. Cl. ..... 343/754; 343/740; 343/753; 343/755; 343/770; 343/795

(58) Field of Classification Search ..... 343/713, 343/753, 768, 785, 854, 909, 754, 755, 740, 343/770, 783, 795
See application file for complete search history.

(56) References Cited

U.S. PATENT DOCUMENTS

| | | | | | |
|---|---|---|---|---|---|
| 3,755,815 | A * | 8/1973 | Stangel et al. | ..... | 342/371 |
| 3,917,022 | A * | 11/1975 | Brooks, Jr. | ..... | 180/127 |
| 4,246,585 | A * | 1/1981 | Mailloux | ..... | 342/373 |
| 4,654,666 | A * | 3/1987 | Wiley | ..... | 342/351 |
| 4,980,692 | A * | 12/1990 | Rudish et al. | ..... | 343/700 MS |
| 5,504,493 | A * | 4/1996 | Hirshfield | ..... | 342/372 |
| 5,650,787 | A * | 7/1997 | Lim et al. | ..... | 342/375 |
| 6,133,888 | A * | 10/2000 | Mohuchy | ..... | 343/770 |
| 6,262,688 | B1 * | 7/2001 | Kasahara | ..... | 343/766 |
| 6,281,853 | B1 * | 8/2001 | Caille et al. | ..... | 343/754 |
| 6,650,291 | B1 * | 11/2003 | West et al. | ..... | 342/371 |
| 7,095,376 | B1 * | 8/2006 | Timothy et al. | ..... | 343/705 |
| 7,358,913 | B2 * | 4/2008 | Ebling et al. | ..... | 343/753 |
| 7,403,166 | B2 * | 7/2008 | Clymer et al. | ..... | 343/713 |
| 2007/0001918 | A1 * | 1/2007 | Ebling et al. | ..... | 343/753 |

* cited by examiner

*Primary Examiner* — Douglas W Owens
*Assistant Examiner* — Chuc Tran
(74) *Attorney, Agent, or Firm* — Finnegan, Henderson, Farabow, Garrett & Dunner, LLP

(57) ABSTRACT

A phased array antenna device is described. The phased array antenna device includes at least one one-dimensional phased array of radiating elements arranged along an array direction, a lens, and a phase control element. The lens is arranged such that divergent beams from the radiating elements are collimated by the lens in a direction orthogonal to the array direction to produce a beam. The phase control element is configured to apply a linear phase gradient to the radiating elements thereby providing one-dimensional electronic beam steering for the antenna device. The antenna device may additionally include one or two mechanical positioners to mechanically move the at least one one-dimensional phased array in directions orthogonal to the array direction, where the phased array enables scanning along the array direction.

44 Claims, 10 Drawing Sheets

LOW PROFILE QUASI-OPTIC PHASED ARRAY ANTENNA

CROSS-REFERENCE TO RELATED PATENT APPLICATIONS

This application claims priority from U.S. Provisional Application U.S. Application 60/924,098, filed Apr. 30, 2007, incorporated herein by reference in its entirety.

FIELD OF THE INVENTION

Embodiments of the present invention relate generally to antennas. In particular, embodiments of the present invention relate to a low profile active quasi-optic phased array antenna.

BACKGROUND OF THE INVENTION

Conventionally there exist several types of communication antenna designs. These include the three-axis pedestal, the two-axis pedestal, and parallel mechanical plate scanning. The three-axis pedestal provides full hemispheric coverage without the "keyhole phenomenon," but are large and complex and the required reflector needs multi-band mechanical radiating elements and mechanical linear polarization adjustments. The two-axis pedestal is less complex, but suffers from the drawback of periodic data outages from the keyhole phenomenon. Parallel mechanical plate scanning also suffers from the mechanical keyhole phenomenon, as well as a requirement for a significant tilt height to achieve a low look angle and bandwidth challenges.

Therefore, the need arises for a cost effective, lightweight multi-band directional satellite communications antenna based on active array technology.

SUMMARY OF THE DISCLOSURE

Embodiments of the present invention address the problems described above and relate to an antenna device.

According to one embodiment of the present invention, there is provided a phased array antenna device. The phased array antenna device comprises at least one one-dimensional phased array of radiating elements arranged along an array direction; a lens arranged such that divergent beams from the radiating elements are collimated by the lens in a direction orthogonal to the array direction to produce a beam; and a phase control element configured to apply a linear phase gradient to the radiating elements thereby providing one-dimensional electronic beam steering for the antenna device.

The phased array antenna device may further comprise a plurality of amplifiers, each amplifier corresponding to a radiating element, providing spatial power combining of the amplifiers at an aperture of the antenna device.

The radiating elements may be spaced to reduce sidelobes to provide lower amplitude weighting to outer radiating elements of the radiating elements.

The gain across the radiating elements may be varied to provide amplitude weighting and reduce sidelobes.

According to another embodiment of the invention, there is provided an antenna device. The antenna device comprises at least one one-dimensional phased array of radiating elements enabling one-dimensional scanning along an array direction; a mechanical positioner supporting the phased array and configured to move the at least one one-dimensional phased array in a direction orthogonal to the array direction.

The antenna device may further comprise a lens arranged such that divergent beams from the radiating elements are collimated by the lens in a direction orthogonal to the array direction to produce a beam; and a phase control element configured to apply a linear phase gradient to the radiating elements thereby providing one-dimensional electronic beam steering for the antenna device.

According to another embodiment of the invention, there is provided an antenna device. The antenna device comprises at least one one-dimensional phased array of radiating elements enabling one-dimensional scanning along an array direction; a first mechanical positioner configured to move the at least one one-dimensional phased array in a first direction orthogonal to the array direction; and a second mechanical positioner configured to move the at least one one-dimensional phased array in a second direction orthogonal to the first direction and the array direction.

BRIEF DESCRIPTION OF THE DRAWINGS

The present invention may be more fully understood by reading the following description of the preferred embodiments of the present invention in conjunction with the appended drawings wherein.

DETAILED DESCRIPTION OF THE PREFERRED EMBODIMENTS

A low profile active quasi-optic phased array antenna method and apparatus is described. In the following description, numerous details are set forth. It will be appreciated, however, to one skilled in the art, that embodiments of the present invention may be practiced without these specific details. In other instances, well-known structures and devices are shown in block diagram form, rather than in detail.

According to one embodiment of the present invention, a low profile active quasi-optic array phased antenna system is provided incorporating a one-dimensional phased array and collimating lens, which may be used for a number of different applications including vehicle mobile satellite communications. The system provides multiple band transmission and reception in a single aperture. The antenna system transmits and receives simultaneously with no mechanical alterations required to change bands. According to one embodiment of the present invention, the antenna system includes an antenna which may be mounted external to a vehicle and may be used with a controller unit mounted internal to the vehicle. The antenna may transmit over multiple bands. For example only, the antenna may transmit over the Ku or Ka-band frequency bandwidths via L-band input signals and also receive over the Ku or Ka-band frequency bandwidths and output signals at L-band. The antenna may transmit over bands other than the Ku or Ka-band. The controller may include GPS and inertial navigation systems and may be configured to acquire, track and re-acquire desired satellites.

The antenna system may incorporate a two-axis mechanical positioner with a third electronically scanned axis (along a one-dimensional phased array direction) to provide complete coverage of the sky with no keyhole, while still maintaining a small size. Phase shifters and amplifiers may be provided to implement the scanning. An active quasi-optic device, such as a lens, drastically reduces the number of radiating elements compared with conventional approaches and the distributed array of radiating elements eliminates the need for a high power, solid state power amplifier. For example, the array of radiating elements may be reduced from a multiple row array to single rows of elements for each band.

Figure 1:
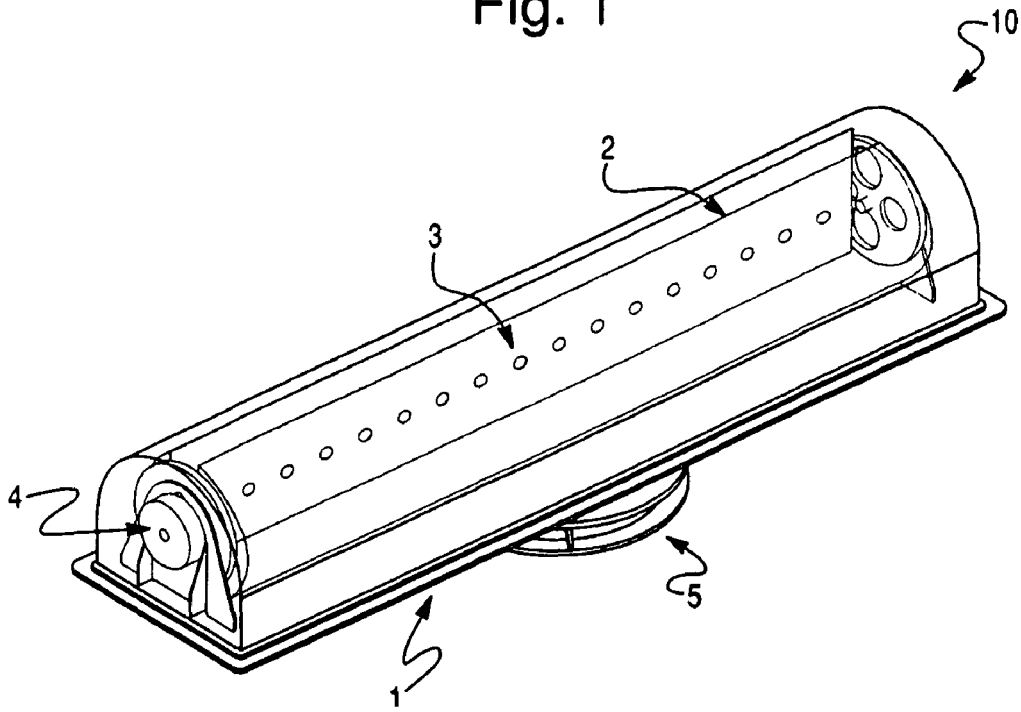
FIG. 1 illustrates generally a low profile active quasi-optic phased array antenna according to one embodiment of the present invention.

An explanation will be given below regarding embodiments of the present invention while referring to the attached drawings. As shown in FIG. 1, an embodiment of a low profile active quasi-optic phased array antenna assembly 10 includes a housing 1, a lens 2, at least one one-dimensional phased array 3 and first and second mechanical positioners 4 and 5 which form a two-axis mechanical positioner. Each of the at least one one-dimensional phased arrays 3 comprises a number of radiating elements 6 arranged along an array direction of the array 3. The array direction in FIG. 1, for example, is along the long axis of the array 3. While FIG. 1 illustrates a single one-dimensional phased array 3, in general the number of one-dimensional phased arrays 3 may be more than one, and may be, for example, two or more.

The lens 2 functions to increase the gain of the antenna in the direction orthogonal to the array direction. The lens 2 may be a refractive lens, as illustrated in FIG. 1. Alternatively, the lens 2 may be a parallel plate or perforated plate lens. The use of the lens helps reduce the number of components needed in the antenna, by allowing for a one-dimensional phased array, while still maintaining gain in the non-scanned array dimension. The lens 2 is arranged to focus the diverging beams from the radiating elements 6 of the one-dimensional phased array 3 into a collimated beam. Absorption losses that occur utilizing this method of combining the diverging beams from the radiating elements 6 of the one-dimensional phased array 3 are very low since combining occurs in free-space. Since the combining occurs at the aperture of the antenna, there is almost no waveguide loss as would exist in a waveguide run from an apparatus to the antenna aperture. According to an embodiment of the present invention, the lens 2 is more efficient than an antenna with just a reflector for collecting radiation from the radiating elements, when the array is scanned.

Preferably, the lens 2 is formed of a material which has a low loss for the radiation frequencies provided by the radiating elements 6. For example, the lens 2 may be formed of a material such as REXOLITE®.

Figure 14A:
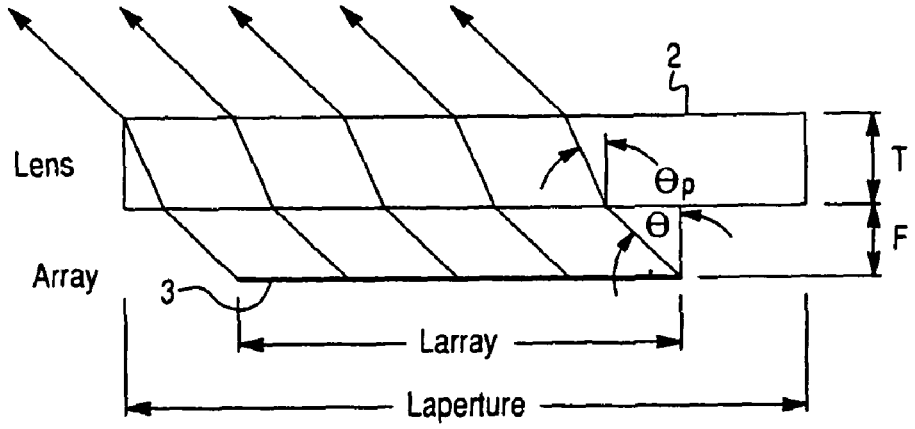
FIGS. 14A, 14B and 14C schematically illustrate side, end, and top views, respectively, of an array-lens system with a one-dimensional array and collimating lens according to an embodiment of the invention.
Figure 14B:
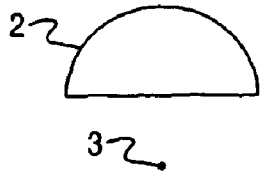
Figure 14C:
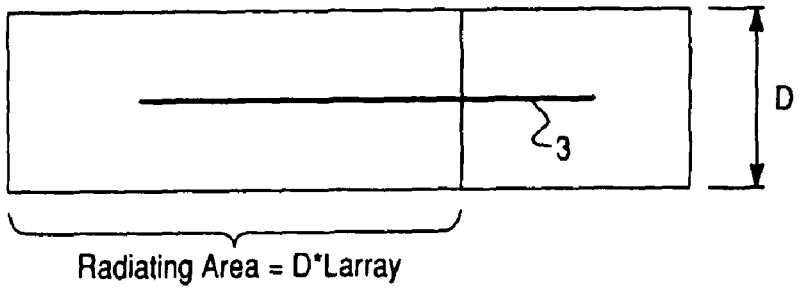
Figure 15A:
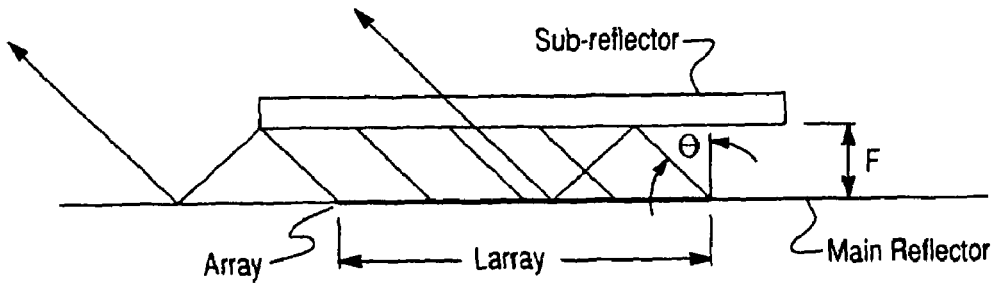
FIGS. 15A, 15B and 15C illustrate views of a system with a reflection element for collecting radiation for comparison to the system of FIGS. 14A, 14B and 14C.
Figure 15B:
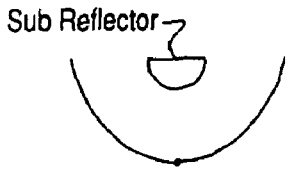
Figure 15C:
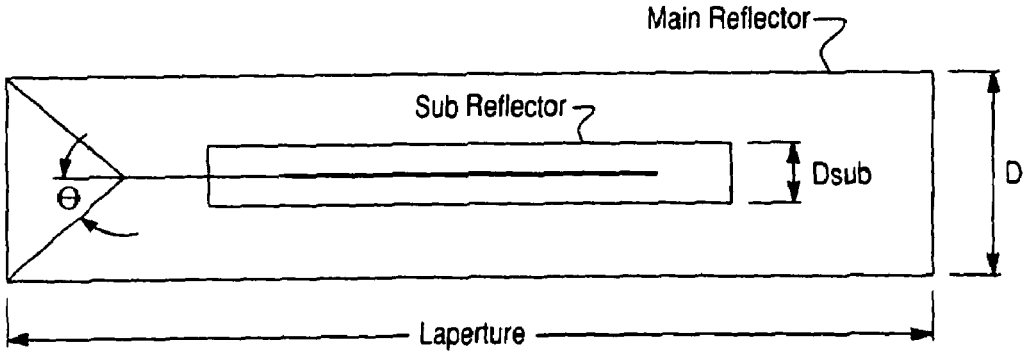

Moreover, the lens 2 provides advantages over a system where reflective elements are used to collect and collimate the radiation from the radiating elements 6 of the one-dimensional phased array 3. For illustration purposes, FIGS. 14A-14C illustrate side, end, and top views, respectively, of an array-lens system with a one-dimensional array 3 and collimating lens 2, while FIGS. 15A-15C illustrate a system with a reflection element for collecting radiation. FIG. 14A shows the array 3 scanned to an angle θ, where the lens thickness and focal length are given by T and F, respectively. The length of the array and the length of the aperture of the antenna are given by $L_{array}$ and $L_{aperture}$, respectively. The aperture width is given as D. In this case, the aperture length is given by $L_{aperture}=L_{array}+2*(F*\tan(\theta)+T*\tan(\theta p))$, where θp can be found by the relationship $\sin(\theta)=n*\sin(\theta p)$, where n is the lens index of refraction.

As one example for comparing a lens system with a reflector system, a system is provided with a rexolite lens (index of refraction n equals 1.59) with D=6 inches, F=1.5 inches, an array with length $L_{array}$=12 inches, and scanning of ±40 degrees. In this case T will be 3.1 inches and the length $L_{aperture}$ will need to be 17.3 inches. FIGS. 15A-1 5C illustrate an analogous reflector system, with a cassegrain reflector. The cassegrain reflector with D=6 inches and F=1.5 (to minimize the height of the reflectors) requires the main reflector to be $L_{aperture}$=22.5 inches, and thus requires a larger aperture. The lens system further has no blockage due to a sub-reflector, as a two reflector system does, nor does it require part of the aperture area to be occupied by radiating elements, as a single reflector system does. This results in higher gain for the lens system. For the example, the radiating area for the lens system described above is 72 square inches for the entire ±40 degree scan, for a 6×17.3 inch antenna. For the analogous cassegrain system described above, by comparison, the radiating area varies with scan angle from 56.4 square inches at boresite to 59.7 square inches at a scan angle of 40 degrees, for a 6×22.5 inch antenna. A separate part of the antenna efficiency will also be lower for the reflector system than for the lens system, since a larger part of the beam from the array will miss the sub-reflector than that which will miss the wider lens. Although gain for the lens is reduced by the dielectric loss of the lens, the dielectric loss can be made much less than the gain given up in going to a reflector system by using low loss lens materials such as REXOLITE™, for example.

Figure 2:
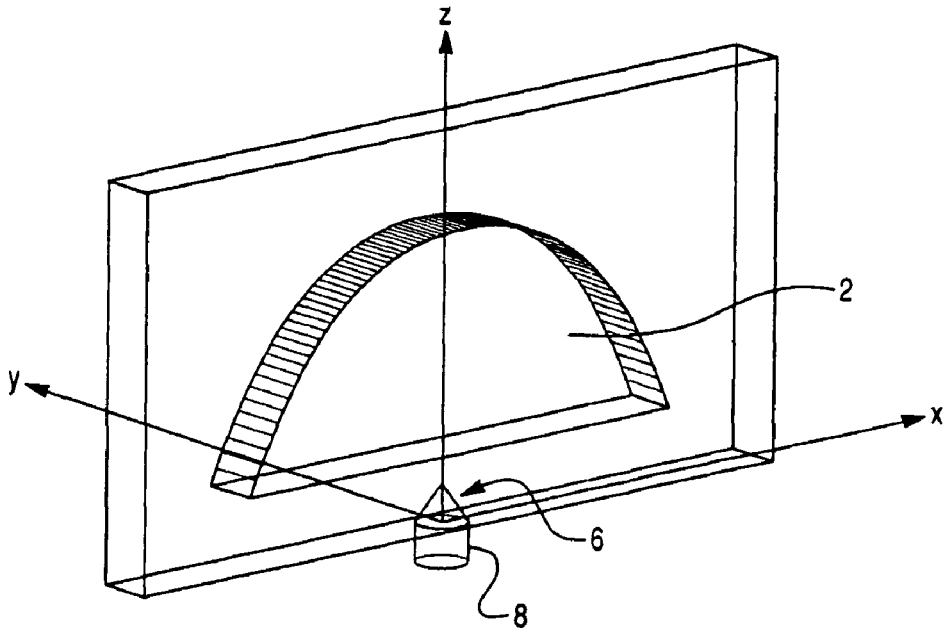
FIG. 2 illustrates a cross-section of the quasi-optic device and waveguide radiating element according to one embodiment of the present invention.

FIG. 2 illustrates a cross-section of the lens 2 and a waveguide as the radiating element 6 of the one-dimensional phased array 3 according to one embodiment of the present invention. One of the advantages of the lens approach for collecting and collimating radiation from the radiating elements is that the optics are independent of the frequency. Thus, the antenna design is simplified. As shown, the radiating element 6 includes a waveguide radiating element 8. The waveguide radiating element 8 as shown in FIG. 2 is circular, but may have cross-sections other than circular. The waveguide radiating element 8 may, for example, comprise a ridged waveguide. According to one embodiment of the present invention, the waveguide radiating element 8 for each radiating element 6 in the one-dimensional array 3 is a TEFLON™ loaded circular waveguide. The lens 2 increases the gain of a single waveguide radiating element 8. This results in an antenna assembly that is very high in efficiency with dramatic reduction in complexity and cost. The lens 2 effectively increases the aperture size of the one-dimensional array 3, thus increasing the gain substantially.

Figure 3:
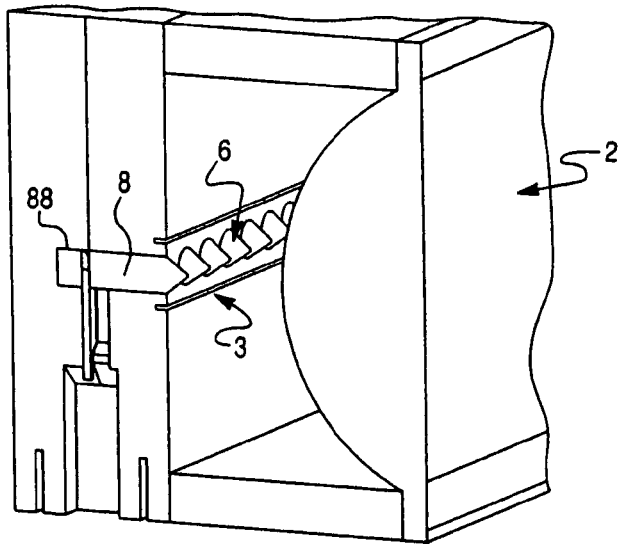
FIG. 3 illustrates a cross-sectional view of the waveguide radiating elements facing the quasi-optic device according to one embodiment of the present invention.
Figure 4:
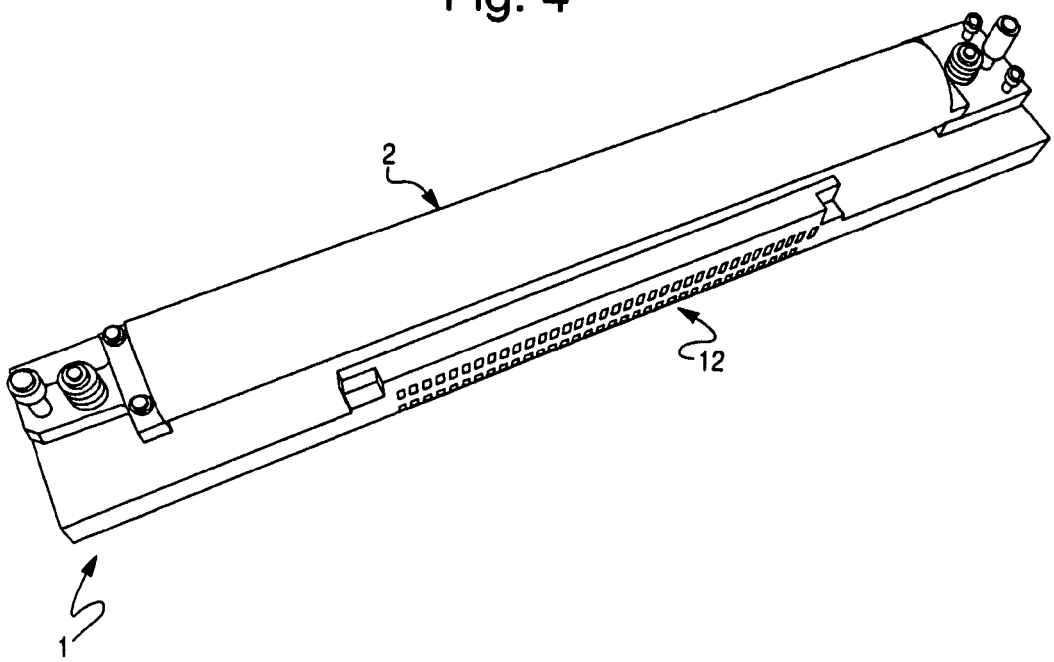
FIG. 4 illustrates waveguide ports provided along a bottom side of the antenna housing for connection to a phase control element, according to one embodiment of the present invention.
Figure 13:
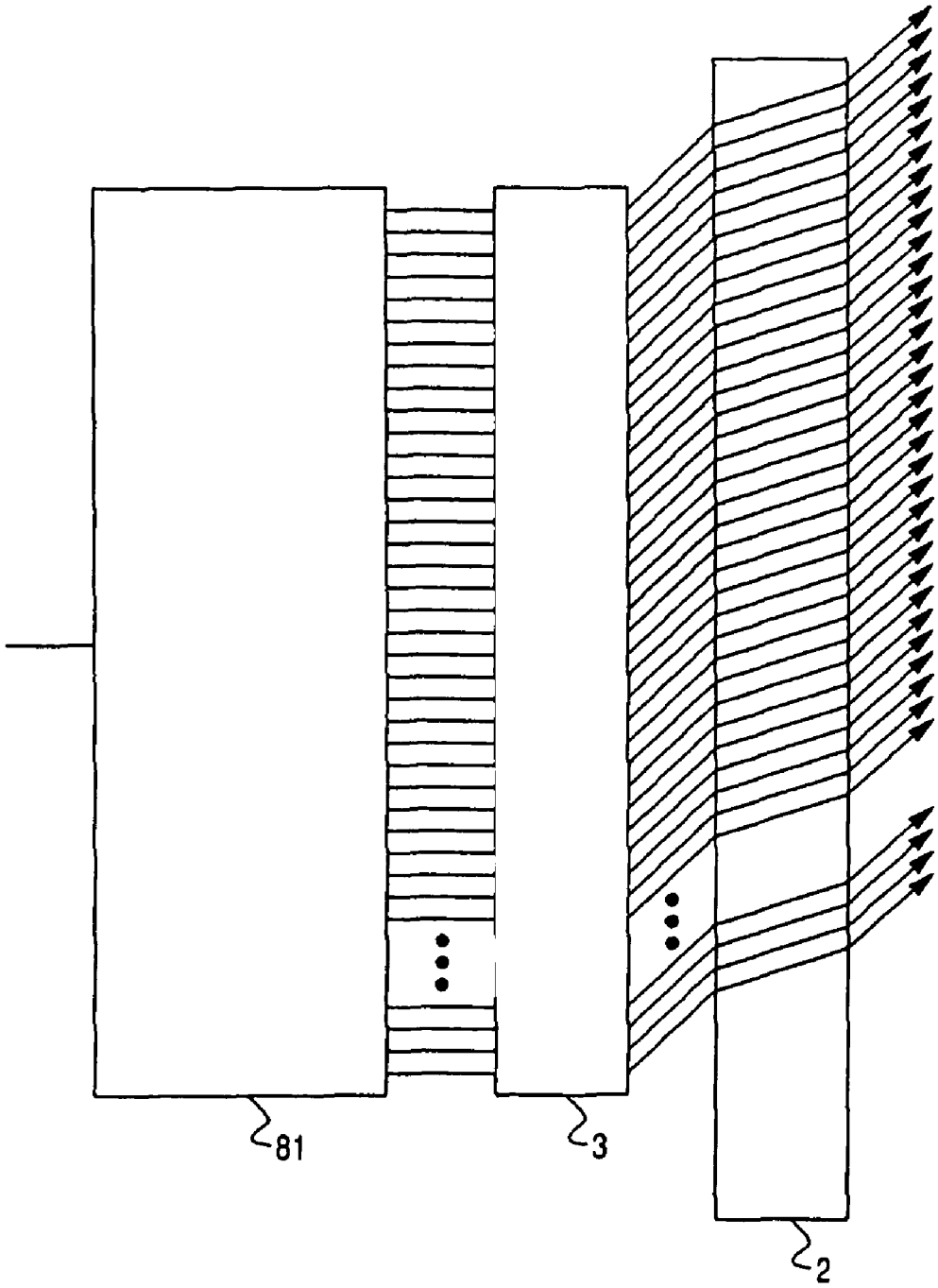
FIG. 13 is a schematic illustrating components of the antenna according to an embodiment of the invention.

FIG. 3 illustrates a cross sectional view of the antenna device showing radiating elements 6 of phased array 3 with waveguide radiating elements 8 facing the lens 2 and FIG. 4 illustrates waveguide ports 12 provided along a bottom portion of the antenna housing 1, to receive input signals fed from a phase control element (not shown in FIG. 4). FIG. 13 is a schematic illustrating components of the antenna including the phase control element 81 for steering the phase of the phased array 3, the phased array 3 and the lens 2. The phase control element 81 applies a linear phase gradient to the phased array 3. The phase control element 81 may comprise, for example a Rotman lens, a Butler Matrix, or a ferro electric element as discussed further below. Returning to FIG. 3, the radiating elements 6 are provided behind the lens 2, A backshort 88 is arranged to direct all radiation along the waveguide radiating elements and to the radiating elements.

Figure 5:
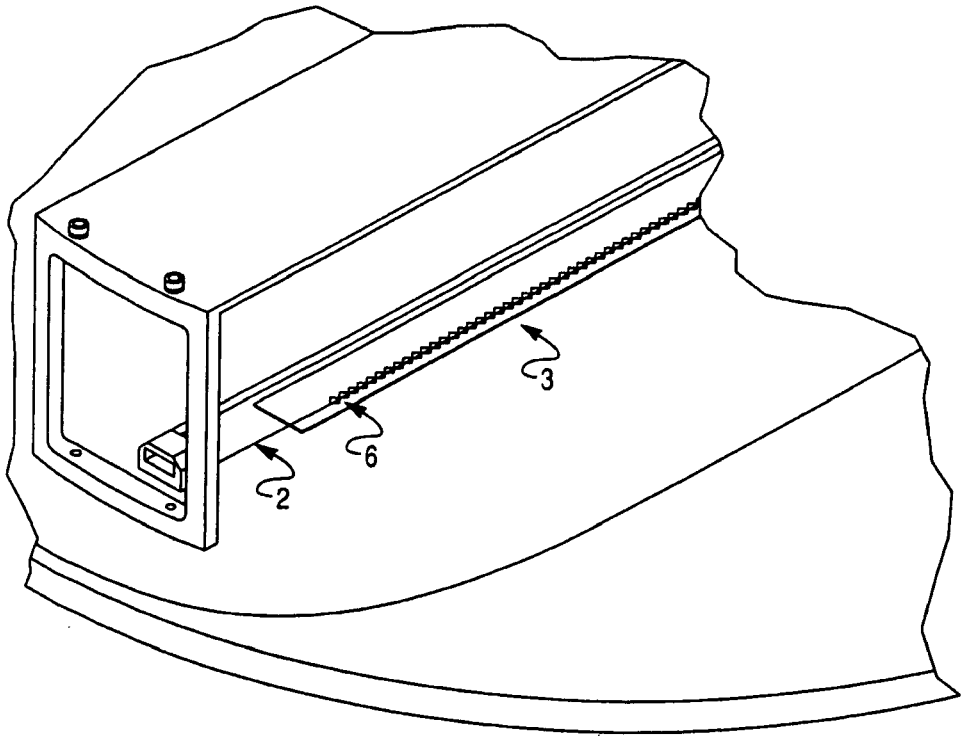
FIG. 5 illustrates an alternative embodiment of the low profile active quasi-optic phased array antenna.
Figure 11:
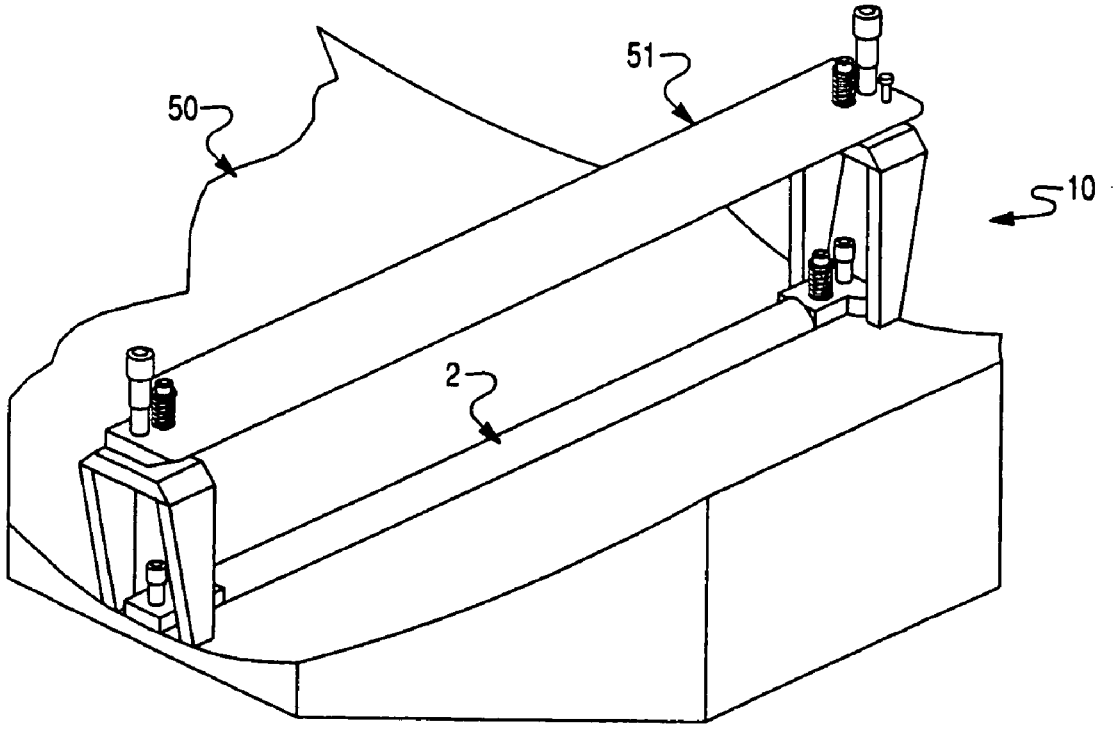
FIG. 11 illustrates a low profile active quasi-optic phased array antenna assembly including a main reflector and a sub-reflector according to an alternative embodiment of the present invention.

According to an alternative embodiment of the present invention as illustrated in FIGS. 5 and 11, a lens 2 may be used to narrow the beamwidth of the one-dimensional phased array 3 to improve the antenna efficiency of a one or two reflector system. For the example, shown in FIG. 5 the lens 2 narrows the beamwidth from an array 3 of microstrip patches such that most of the beam will impinge upon a sub-reflector (see FIG. 11) positioned above the lens. This reduces the size of the sub-reflector and the blockage from the sub-reflector.

Figure 6:
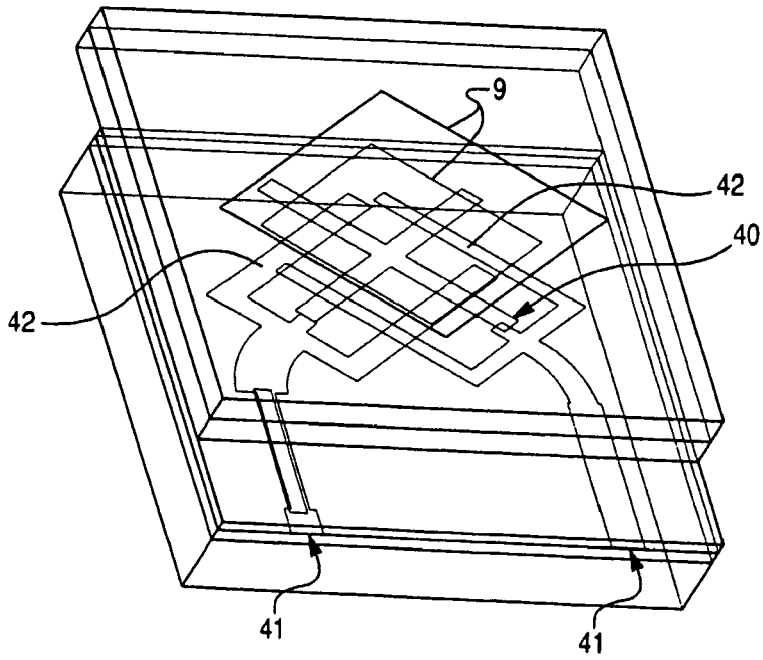
FIG. 6 illustrates split microstrip lines implemented as two orthogonal radiating elements according to an alternative embodiment of the present invention.

According to an alternative embodiment of the present invention as illustrated in FIG. 6, the one-dimensional phased array 3 includes a plurality of microstrip patches 9 as the radiating elements 6, where each of the radiating elements 6 corresponds to a pair of stacked patches 9. FIG. 6 illustrates the stacked patches 9 implemented for split microstrip lines (or probes) 42, including microstrip input/outputs 41 for the microstrip lines, as two orthogonal radiating elements for the stacked patches 9. The microstrip lines 42 may be implemented as split tee microstrip lines as shown. FIG. 6 also illustrates at least one slot 40, which is arranged to excite the patches 9.

As a further alternative, the radiating elements may comprise end-launch radiators, such as Vivaldi antennas.

Figure 7:
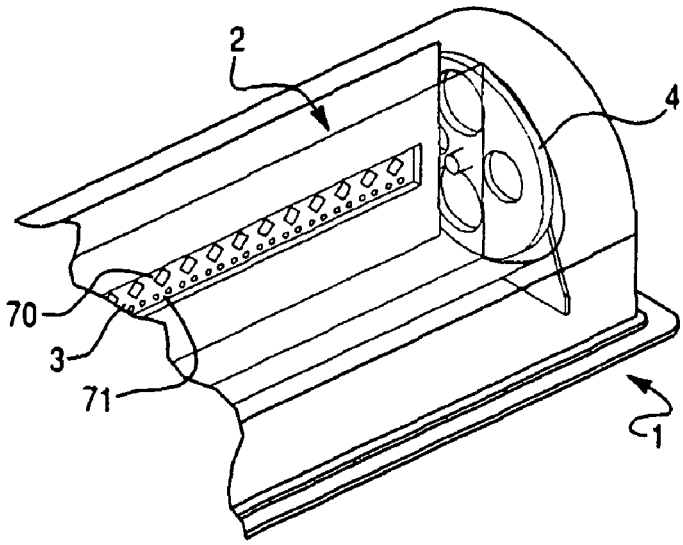
FIG. 7 illustrates arrays of patches for a multi-band antenna according to one embodiment of the present invention.

FIG. 7 illustrates sets of patches for a multi-band antenna according to one embodiment of the present invention. FIG. 7 illustrates an embodiment where the number of bands is two. As discussed above, in general the number of bands may alternatively be one or more than one, for example. In FIG. 7, the at least one one-dimensional phased array 3 comprises two one-dimensional phased arrays 3, one for each band. The at least one one-dimensional phased array 3 may be arranged in a parallel fashion in a focal plane of the lens. One of the one-dimensional phased arrays 3 comprises a plurality of patches 70 as radiating elements, while the other one-dimensional phased array 3 comprises a plurality of patches 71 as radiating elements. Each of the two communication bands require their own array 3 of radiating elements. By way of example only, a Ka band may use two 0.015 inch thick DUROID™ substrate layers with stacked-patches 71, and by way of example only, a Ku band may use two 0.030 inch thick DUROID™ layers also with stacked patches 70. These two arrays 3 are set side-by-side with the Ku array at the focal point of the lens and the Ka array offset by 0.3 inches from the focal point as illustrated in FIG. 7. While this offset reduces the antenna efficiency over 30-31 GHz ( the higher Ka-band sub-band) from 75% to 65% (a 0.6 dB drop in gain), and alters the pointing of the antenna by 4.5 degrees, it allows the antenna to be changed from Ku to Ka-band with no mechanical adjustment. For this particular system, there is more G/T (antenna gain/system noise temperature) and EIRP (effective isotropic radiated power) margin at the Ka-band, even after offsetting the Ka array, and the altered pointing can be accounted for in the initial antenna calibration. The arrays may be configured in this way because the circuitry for each array may extend out to only one side of the patches in that array.

Figure 8:
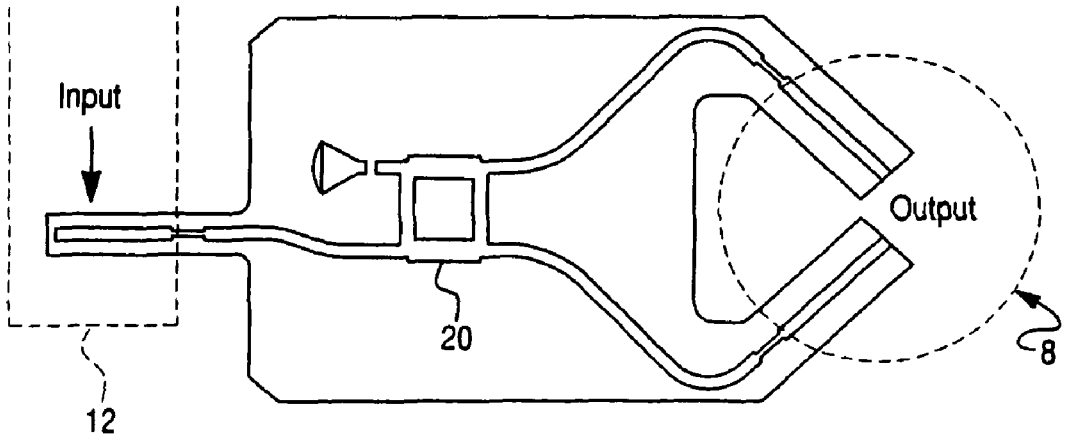
FIG. 8 illustrates a circular polarization circuit according to one embodiment of the present invention.

FIG. 8 illustrates a circular polarization circuit according to one embodiment of the present invention for use with the antenna design employing waveguide radiating elements as shown in FIGS. 3 and 4. The polarization for the lens antenna requires that the polarization be selectable between left hand circular polarization (LHCP) and right hand circular polarization (RHCP) or linear polarization (horizontal and vertical). For circular polarization, a circular polarization circuit such as illustrated in FIG. 8 is provided for each radiating element 6 in the one-dimensional phased array 3. The dashed lines in FIG. 8 represent waveguide outlines for rectangular waveguide inputs 12 (See also FIG. 4) and circular waveguide radiating elements 8 (See also FIG. 3). Input signals are routed through a 90 degree hybrid coupler 20. The output signals are then combined orthogonally in the output circular waveguide 8 to produce circular polarization. Alternatively the hybrid coupler may provide a shift other than 90 degrees so that the output signals in general have an elliptical polarization.

A similar orthogonal launch scheme may be employed in the alternative embodiment with the primary difference being a radiating patch antenna (illustrated in FIGS. 5 and 6) as opposed to a circular waveguide 8. The antenna achieves polarization diversity through a switching matrix. The switches are typically PIN diode switches and the circuitry is arranged such that a single input signal can be routed through either input of a hybrid coupler to achieve RHCP or LHCP (right-hand circular polarization or left-hand circular polarization) or can bypass the hybrid coupler for horizontal or vertical linear polarization.

Figure 9:
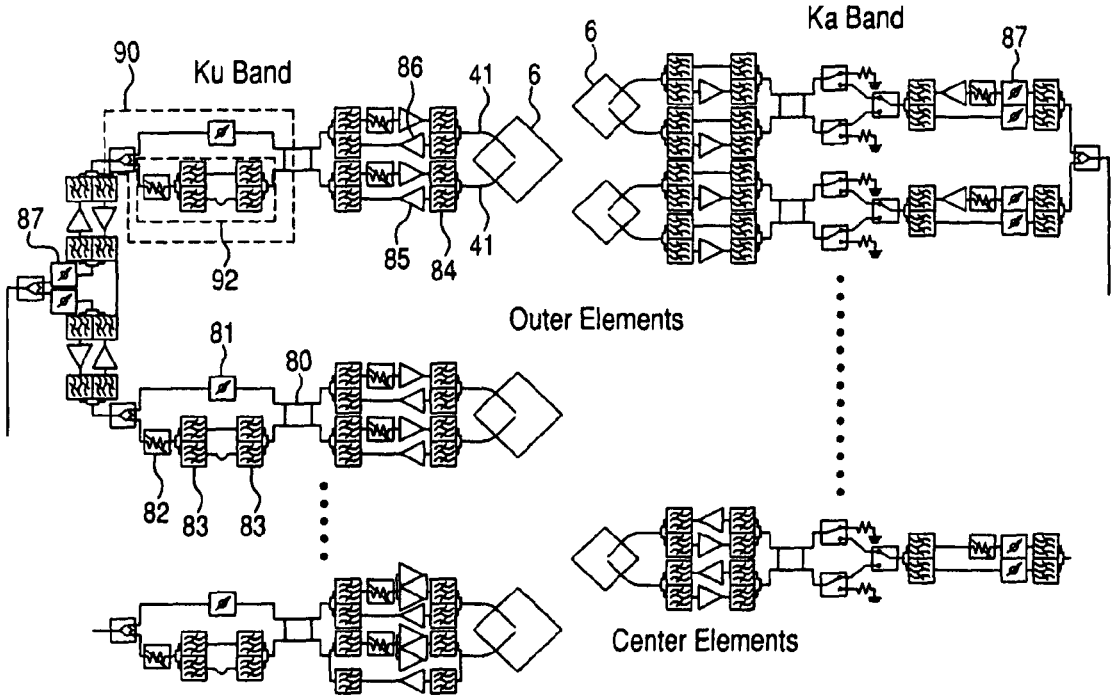
FIG. 9 illustrates an RF circuit for Ku and Ka band arrays according to one embodiment of the present invention.

FIG. 9 illustrates an RF circuit for use with a system providing the Ku-band and Ka band. For the Ku-band, the linear polarization must be rotationally steered. This can be accomplished with a branch-line coupler 80 and phase control (shifting) elements 81. An input signal is split with equal phase and re-combined using a 90 degree hybrid. For example, FIG. 9 illustrates an RF circuit for providing input to stacked patch array elements, where the RF circuit includes a polarization rotation circuit 90 with a hybrid 80. The phase shifting element 81 changes the amount of power that goes into one or the other of the two orthogonal output lines and rotates the resulting linear polarization by 180 degrees. This is all that is required since a 180 degree polarization change is equivalent to a 360 degree change. For example, a 95 degree polarization is equivalent to a −85 degree polarization. On the other side of the signal split 92, an attenuator 82 balances the loss in the phase shifter. Filters 83 form two diplexers to separate the transmit and receive bands, and the difference in line length between the diplexers is adjusted so that the polarization difference between the transmit and receive bands will always be 90 degrees, and the transmit and receive bands will therefore be orthogonal.

FIG. 9 illustrates an RF circuit for exciting the two band arrays of the antenna of FIG. 7 according to an embodiment of the present invention using Ku and Ka bands. The spacing between the radiating elements may be, for example, approximately 0.652 inch for the Ku-band and one-half of that (approximately 0.281 inch) for the Ka-band. The circuit for each band has a stacked patch radiating element 9 with two orthogonal microstrip lines, such as that shown in FIG. 6. Each of the lines first meets a microstrip diplexer circuit 84 which separates the transmit band from the receive band. In the Ku-band, each diplexer arm 84 has a low noise amplifier (LNA) 85 for receiving or a driver amplifier (DA) 86 for transmitting. The low noise amplifier sets the noise figure for the system by providing enough gain to minimize the noise figure contribution of the passive elements between it and the next low noise amplifier stage. The DA provides enough output power to meet the EIRP requirements when combined with the other DAs. An element taper for sidelobe reduction is applied by attenuators before the DA. Center elements have two amplifiers combined in parallel to achieve higher power levels without saturating the amplifiers. Note that this taper can be applied to the transmitter separately due to the transmit and receive splitting at the diplexers, so that no noise figure degradation is suffered from transmitter sidelobe reduction.

For the RF circuit of FIG. 9, electronic scanning of the one-dimensional phased array 3 is accomplished with the phase to various elements set by ferro-electric phase shifters 87 in the circuit path to each element. The third axis cross elevation direction may be electronically scanned +/−20 degrees to eliminate the keyhole and to reduce the amount of mechanical movement in the two mechanical axes provided by the first and second mechanical positions 4 and 5 (See FIG. 1). According to one embodiment of the present invention, these phase shifters may be analog, flip-chip mounted circuit elements having the advantages of low cost, high speed, single bias control and virtually zero power consumption. The phase shifters provide continuous analog phase variation and uniform group delay.

The spacing between path elements is 0.69 of a free space wavelength at the highest frequency for each band (14.5 GHz for Ku-band and 31 GHz for Ka-band). This spacing allows electronic scanning to +/−20 degrees with no grating lobes present. It also allows a total of 64 Ku-band elements and 128 Ka-band elements, for example, over a distance of 36 inches. 64 and 128 are convenient numbers for combining all of the elements together to a single input/output, and a 36 inch×6.3 inch lens produces enough gain for a G/T>12 at 11.7 GHz (with a system noise figure of 1.1 dB).

Figure 12:
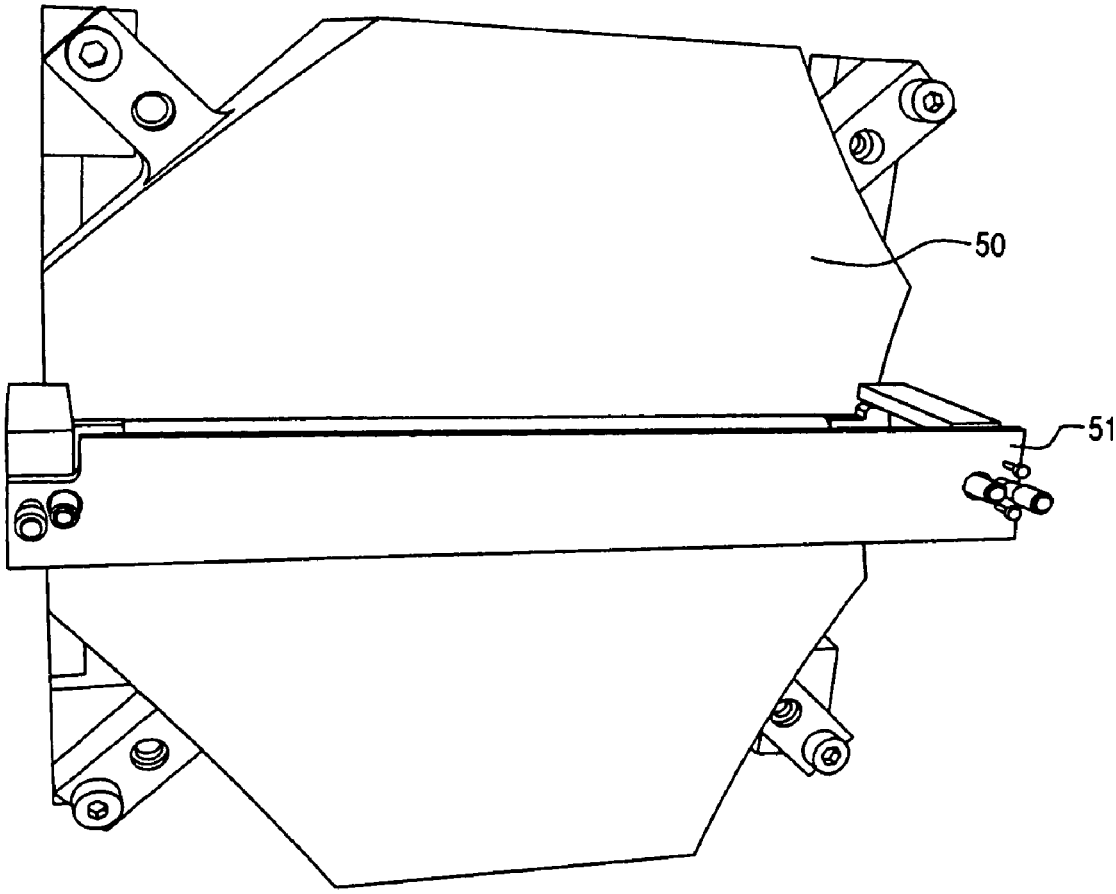
FIG. 12 illustrates a top view of the low profile active quasi-optic phased array antenna assembly of FIG. 11.

FIGS. 11-12 illustrate a phased array antenna assembly including a main reflector 50 and a sub-reflector 51 according to an embodiment of the present invention. As illustrated, the assembly includes a main reflector 50 and sub-reflector 51 in addition to the lens 2 of the phased array antenna 10. The two reflectors are used along with the lens to increase the gain of the antenna by further collimating diverging beams from the lens 2 originating from radiating elements 6 (not shown in FIG. 11) into a collimated beam. Thus, the reflectors 50 and 51 act to further collimate the beam diverging from the lens 2. FIG. 12 illustrates a top view of the FIG. 11 system.

Figure 10:
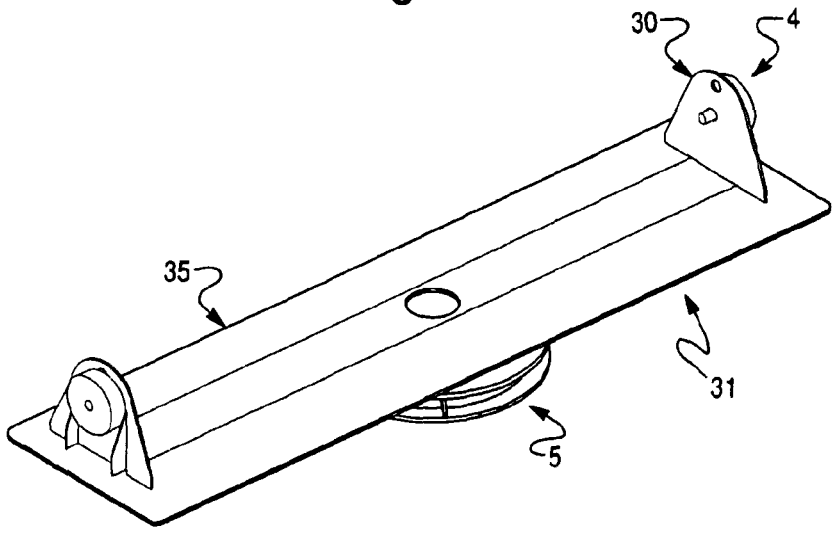
FIG. 10 illustrates a two-axis positioner assembly of the three-axis system according to one embodiment of the present invention.

FIG. 10 illustrates a two-axis positioner assembly of the three-axis system according to an embodiment of the present invention. The positioner assembly 35 includes a first mechanical positioner 4 as an elevation positioner and a second mechanical positioner 5 as an azimuth positioner. The azimuth positioner 5 includes a rotating platform 31 mounted to a direct drive assembly. Antenna and RF sub-assemblies are mounted on the rotating positioner platform 31. A motor assembly for the azimuth positioner 5 may be mounted to the direct drive assembly. The elevation positioner 4 includes yoke supporting type antenna structures 30 provided on each side of the rotating positioner platform 31. The motor assembly for the elevation positioner 5 is mounted to the yoke supporting antenna structures 30.

The phased array antenna assembly 10 (see FIG. 1) rotates in elevation and azimuth with the first and second mechanical positioners 4 and 5, respectively. Accordingly, the combination of mechanical scanning in the azimuth and elevation, along with electrical scanning of the phased array provides the antenna system three axis capability with only two mechanically controlled axes. Azimuth and elevation is accomplished with mechanical steering (mechanical positioners 4 and 5) and electrical scanning of the phased array elements allows cross-elevation scanning. Electrically scanning in cross-elevation eliminates the mechanical positioner that would normally be required. The reduced weight on the elevation axis also reduces cost by allowing a simpler elevation control motor.

The above antenna design provides an approach that adds an electronically scanned third axis to a two-axis mechanical system which avoids the keyhole phenomenon without adding to the complexity and cost of a large number of elements associated with active or passive arrays or the mechanical complexity and height of a three-axis pedestal, while at the same time achieving bandwidth requirements, polarization diversity and tracking requirements.

The three-axis system as described above, where the first and second mechanical positioners allow for scanning in the azimuth and elevation direction, while electrical scanning provides for cross-elevation scanning, allows for keyhole elimination. For a two-axis system providing scanning in the azimuth and elevation directions, as the angle of elevation approaches 90 degrees, the velocity and acceleration required by the azimuth axis approaches infinity. In practice this results in a loss of tracking, and the zone of pointing at which this occurs is known as the keyhole. This keyhole effect is eliminated by allowing for electrical scanning in the cross-elevation direction orthogonal to the azimuth and elevation directions. The reduced weight on the elevation axis also reduces cost by allowing a simpler elevation control motor.

A one-dimensional array uses a lens for low loss combining. The one-dimensional array represents a huge cost savings over a two-dimensional array using M×1 active elements rather than M×N elements.

Polarization diversity and polarization steering is supported by electronic switching in one band and by electronic phase shifting in the other band.

While the invention has been described with reference to several embodiments thereof, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiments disclosed as the best mode contemplated for carrying out this invention, but that the invention will include all embodiments falling within the scope of the appended claims.

What is claimed is:

1. A phased array antenna device, comprising:

at least one one-dimensional phased array of radiating elements arranged along an array direction, the radiating elements comprising waveguide radiating elements;

a lens arranged such that divergent beams from the radiating elements are collimated by the lens in a direction orthogonal to the array direction to produce a beam;

a phase control element configured to apply a linear phase gradient to the radiating elements thereby providing one-dimensional electronic beam steering for the antenna device;

a plurality of probes arranged in pairs, each pair comprising two orthogonal probes arranged to excite a respective one of the waveguide radiating elements; and a backshort arranged to direct all radiation toward the antenna device, wherein the probes of a pair are configured so that each probe of the pair can be excited independently to produce different polarizations;

wherein a gain across the radiating elements is varied to provide amplitude weighting and reduce sidelobes.

2. The antenna device according to claim 1, further comprising a plurality of amplifiers, each amplifier corresponding to a radiating element, providing spatial power combining of the amplifiers at an aperture of the antenna device.

3. The antenna device according to claim 1, wherein the phase control element comprises a Rotman lens.

4. The antenna device according to claim 1, wherein the lens comprises a refractive lens.

5. The antenna device according to claim 4, further comprising a reflector arranged to further collimate the beam diverging from the refractive lens.

6. The antenna device according to claim 1, wherein the lens comprises at least one of a set of: a parallel-plate lens and a perforated plate lens.

7. The antenna device according to claim 1, wherein the phase control element comprises an electronic phase shifter arranged along a path feeding each radiating element.

8. The antenna device according to claim 1, wherein the phase control element comprises a Butler Matrix.

9. The antenna device according to claim 1, wherein the radiating elements are spaced to reduce sidelobes to provide lower amplitude weighting to outer radiating elements of the radiating elements.

10. The antenna device according to claim 1, wherein the orthogonal probes of a pair are arranged to be excited simultaneously, and further comprising a phase shifter arranged between the two orthogonal probes of a pair to produce different elliptical polarizations.

11. The antenna device according to claim 10, wherein the phase shifter is arranged between the two orthogonal probes of a pair to produce at least one of the set of: RHCP polarization and LHCP polarization.

12. The antenna device according to claim 10, wherein the phase shifter comprises an RF hybrid.

13. The antenna device according to claim 1, wherein the waveguide radiating elements comprise circular waveguide radiating elements which are dielectrically loaded.

14. The antenna device according to claim 1, wherein the at least one one-dimensional phased array comprises multiple parallel one-dimensional arrays arranged in a focal plane of the lens, each one-dimensional array covering a different frequency band.

15. The antenna device according to claim 1, wherein the radiating elements further comprise ridged waveguides for wideband operation.

16. The antenna device according to claim 1, wherein the radiating elements further comprise end-launch radiators.

17. The antenna device according to claim 16, wherein the end-launch radiators comprise a Vivaldi antenna.

18. An antenna device, comprising:

at least one one-dimensional phased array of radiating elements enabling one-dimensional scanning along an array direction, the radiating elements comprising waveguide radiating elements;

a lens arranged such that divergent beams from the radiating elements are collimated by the lens in a direction orthogonal to the array direction to produce a beam;

a phase control element configured to apply a linear phase gradient to the radiating elements thereby providing one-dimensional electronic beam steering for the antenna device;

a mechanical positioner supporting the phased array and configured to move the at least one one-dimensional phased array in a direction orthogonal to the array direction;

a plurality of probes arranged in pairs, each pair comprising two orthogonal probes arranged to excite a respective one of the waveguide radiating elements; and a backshort arranged to direct all radiation toward the antenna device, wherein the probes of a pair are configured so that each probe of the pair can be excited independently to produce different polarizations;

wherein a gain across the radiating elements is varied to provide amplitude weighting and reduce sidelobes.

19. The antenna device according to claim 18, wherein the at least one one-dimensional phased array comprises multiple parallel one-dimensional arrays arranged in a focal plane of the lens, each one-dimensional array covering a different frequency band.

20. An antenna device, comprising:

at least one one-dimensional phased array of radiating elements enabling one-dimensional scanning along an array direction, the radiating elements comprising waveguide radiating elements;

a lens arranged such that divergent beams from the radiating elements are collimated by the lens in a direction orthogonal to the array direction to produce a beam;

a phase control element configured to apply a linear phase gradient to the radiating elements thereby providing one-dimensional electronic beam steering for the antenna device;

a first mechanical positioner configured to move the at least one one-dimensional phased array in a first direction orthogonal to the array direction; and a second mechanical positioner configured to move the at least one one-dimensional phased array in a second direction orthogonal to the first direction and the array direction;

a plurality of probes arranged in pairs, each pair comprising two orthogonal probes arranged to excite a respective one of the waveguide radiating elements; and a backshort arranged to direct all radiation toward the antenna device, wherein the probes of a pair are configured so that each probe of the pair can be excited independently to produce different polarizations;

wherein a gain across the radiating elements is varied to provide amplitude weighting and reduce sidelobes.

21. The antenna device according to claim 20, wherein the at least one one-dimensional phased array comprises multiple parallel one-dimensional arrays arranged in a focal plane of the lens, each one-dimensional array covering a different frequency band.

22. The antenna device according to claim 20, wherein three scanning axes are used for key-hole elimination in satellite tracking applications.

23. The antenna device according to claim 20, wherein the first mechanical positioner comprises a rotating platform configured to rotate in the first direction, the second mechanical positioner comprises a yoke supporting structure supporting the at least one one-dimensional phased array and configured to rotate in the second direction, and the antenna device further comprising a drive assembly for driving the first mechanical positioner in an azimuth direction as the first direction and for driving the second mechanical positioner in an elevation direction as the second direction.

24. A phased array antenna device, comprising:

at least one one-dimensional phased array of radiating elements arranged along an array direction, the radiating elements comprising microstrip patches;

a lens arranged such that divergent beams from the radiating elements are collimated by the lens in a direction orthogonal to the array direction to produce a beam;

a phase control element configured to apply a linear phase gradient to the radiating elements thereby providing one-dimensional electronic beam steering for the antenna device; and a plurality of slots arranged to excite the microstrip patches, the plurality of slots further arranged in pairs of orthogonal slots, each pair arranged to excite a corresponding one of the microstrip patches along two directions;

a plurality of microstrip probes arranged in pairs, each microstrip probe of one of the pairs arranged to excite a respective slot; and at least one of a set of a phase-shifter and a hybrid arranged to provide a phase shift between the microstrip probes of a pair to produce elliptical polarization;

wherein a gain across the radiating elements is varied to provide amplitude weighting and reduce sidelobes.

25. The antenna device according to claim 24, further comprising a plurality of amplifiers, each amplifier corresponding to a radiating element, providing spatial power combining of the amplifiers at an aperture of the antenna device.

26. The antenna device according to claim 24, wherein the phase control element comprises a Rotman lens.

27. The antenna device according to claim 24, wherein the lens comprises a refractive lens.

28. The antenna device according to claim 27, further comprising a reflector arranged to further collimate the beam diverging from the refractive lens.

29. The antenna device according to claim 24, wherein the lens comprises at least one of a set of: a parallel-plate lens and a perforated plate lens.

30. The antenna device according to claim 24, wherein the phase control element comprises an electronic phase shifter arranged along a path feeding each radiating element.

31. The antenna device according to claim 24, wherein the phase control element comprises a Butler Matrix.

32. The antenna device according to claim 24, wherein the radiating elements are spaced to reduce sidelobes to provide lower amplitude weighting to outer radiating elements of the radiating elements.

33. The antenna device according to claim 24, wherein the at least one of a set of a phase-shifter and a hybrid arranged to provide a phase shift between the microstrip probes of a pair to produce elliptical polarization is further arranged between the microstrip probes of a pair to produce at least one of the set of: RHCP polarization and LHCP polarization.

34. The antenna device according to claim 24, wherein the hybrid comprises an RF hybrid.

35. The antenna device according to claim 24, wherein the at least one one-dimensional phased array comprises multiple parallel one-dimensional arrays arranged in a focal plane of the lens, each one-dimensional array covering a different frequency band.

36. The antenna device according to claim 24, wherein the radiating elements further comprise end-launch radiators.

37. The antenna device according to claim 36, wherein the end-launch radiators comprise a Vivaldi antenna.

38. The antenna device according to claim 24, wherein the microstrip patches are vertically stacked patches that produce multi-band operation.

39. An antenna device, comprising:

at least one one-dimensional phased array of radiating elements enabling one-dimentional scanning along an array direction, the radiating elements comprising microstrip patches;

a lens arranged such that divergent beams from the radiating elements are collimated by the lens in a direction orthogonal to the array direction to produce a beam;

a phase control element configured to apply a linear phase gradient to the radiating elements thereby providing one-dimensional electronic beam steering for the antenna device;

a mechanical positioner supporting the phased array and configured to move the at least one one-dimensional phased array in a direction orthogonal to the array direction;

a plurality of slots arranged to excite the microstrip patches, the plurality of slots further arranged in pairs of orthogonal slots, each pair arranged to excite a corresponding one of the microstrip patches along two directions;

a plurality of microstrip probes arranged in pairs, each microstrip probe of one of the pairs arranged to excite a respective slot; and at least one of a set of a phase-shifter and a hybrid arranged to provide a phase shift between the microstrip probes of a pair to produce elliptical polarization;

wherein a gain across the radiating elements is varied to provide amplitude weighting and reduce sidelobes.

40. The antenna device according to claim 39, wherein the at least one one-dimensional phased array comprises multiple parallel one-dimensional arrays arranged in a focal plane of the lens, each one-dimensional array covering a different frequency band.

41. An antenna device, comprising:

at least one one-dimensional phased array of radiating elements enabling one-dimensional scanning along an array direction, the radiating elements comprising microstrip patches;

a lens arranged such that divergent beams from the radiating elements are collimated by the lens in a direction orthogonal to the array direction to produce a beam;

a phase control element configured to apply a linear phase gradient to the radiating elements thereby providing one-dimensional electronic beam steering for the antenna device;

a first mechanical positioner configured to move the at least one one-dimensional phased array in a first direction orthogonal to the array direction;

a second mechanical positioner configured to move the at least one one-dimensional phased array in a second direction orthogonal to the first direction and the array direction;

a plurality of slots arranged to excite the microstrip patches, the plurality of slots further arranged in pairs of orthogonal slots, each pair arranged to excite a corresponding one of the microstrip patches along two directions;

a plurality of microstrip probes arranged in pairs, each microstrip probe of one of the pairs arranged to excite a respective slot; and at least one of a set of a phase-shifter and a hybrid arranged to provide a phase shift between the microstrip probes of a pair to produce elliptical polarization;

wherein a gain across the radiating elements is varied to provide amplitude weighting and reduce sidelobes.

42. The antenna device according to claim 41, wherein the at least one one-dimensional phased array comprises multiple parallel one-dimensional arrays arranged in a focal plane of the lens, each one-dimensional array covering a different frequency band.

43. The antenna device according to claim 41, wherein three scanning axes are used for key-hole elimination in satellite tracking applications.

44. The antenna device according to claim 41, wherein the first mechanical positioner comprises a rotating platform configured to rotate in the first direction, the second mechanical positioner comprises a yoke supporting structure supporting the at least one one-dimensional phased array and configured to rotate in the second direction, and the antenna device further comprising a drive assembly for driving the first mechanical positioner in an azimuth direction as the first direction and for driving the second mechanical positioner in an elevation direction as the second direction.

* * * * *

UNITED STATES PATENT AND TRADEMARK OFFICE

CERTIFICATE OF CORRECTION

PATENT NO. : 8,134,511 B2
APPLICATION NO. : 12/149273
DATED : March 13, 2012
INVENTOR(S) : Christopher Tze-Chao Koh et al.

It is certified that error appears in the above-identified patent and that said Letters Patent is hereby corrected as shown below:

In claim 39, column 12, line 8, "one-dimentional" should read --one-dimensional--.

Signed and Sealed this
Twenty-ninth Day of May, 2012

David J. Kappos

David J. Kappos
*Director of the United States Patent and Trademark Office*